US010842251B1

(12) United States Patent
McMillan, II et al.

(10) Patent No.: US 10,842,251 B1
(45) Date of Patent: Nov. 24, 2020

(54) MAGNETIC CLIPPING DEVICE FOR RETAINING GLASSES TO AN ARTICLE OF CLOTHING AND METHOD THEREOF

(71) Applicants: Leartis Jay McMillan, II, Secaucus, NJ (US); Haley Compton, Secaucus, NJ (US)

(72) Inventors: Leartis Jay McMillan, II, Secaucus, NJ (US); Haley Compton, Secaucus, NJ (US)

( * ) Notice: Subject to any disclaimer, the term of this patent is extended or adjusted under 35 U.S.C. 154(b) by 0 days.

(21) Appl. No.: 16/679,602

(22) Filed: Nov. 11, 2019

(51) Int. Cl.

| | |
|---|---|
| ***A45F 5/02*** | (2006.01) |
| ***A45C 11/04*** | (2006.01) |
| ***A45C 13/00*** | (2006.01) |
| ***A45C 13/04*** | (2006.01) |
| ***A45C 13/10*** | (2006.01) |

(52) U.S. Cl.
CPC ..... *A45F 5/02* (2013.01); *A45C 11/04* (2013.01); *A45C 13/005* (2013.01); *A45C 13/04* (2013.01); *A45C 13/1069* (2013.01); *A45F 2200/0541* (2013.01)

(58) Field of Classification Search
CPC .... A45F 5/02; A45F 2200/0541; A45C 11/04; A45C 13/005; A45C 13/04; A45C 13/1069
See application file for complete search history.

(56) References Cited

U.S. PATENT DOCUMENTS

| | | | | |
|---|---|---|---|---|
| 7,296,889 | B2 * | 11/2007 | Dietz | A45F 5/02 24/3.3 |
| D756,631 | S * | 5/2016 | Praamsma | D3/219 |
| 2004/0237262 | A1 * | 12/2004 | Arnone | B43K 25/026 24/10 R |
| 2005/0097711 | A1 * | 5/2005 | Halstead | A45C 1/06 24/303 |
| 2010/0157237 | A1 * | 6/2010 | Mor | A45F 5/022 351/155 |
| 2010/0176173 | A1 * | 7/2010 | Felts | F42B 39/02 224/665 |
| 2010/0180406 | A1 * | 7/2010 | Mor | G02C 3/04 24/3.3 |
| 2014/0216954 | A1 * | 8/2014 | Law | A45F 5/02 206/45.23 |
| 2018/0279749 | A1 * | 10/2018 | Quillmann | A45F 5/02 |

* cited by examiner

*Primary Examiner* — Robert Sandy
*Assistant Examiner* — David M Upchurch
(74) *Attorney, Agent, or Firm* — John C Laurence Law, PLLC

(57) ABSTRACT

A magnetic clipping device for retaining glasses to an article of clothing, comprising a first flexible leg, a first magnetic element embedded within the first flexible leg, a second flexible leg, a second magnetic element embedded within the second flexible leg, a hinge directly coupling the first flexible leg and the second flexible leg, the hinge allowing the first flexible leg and the second flexible leg to bend towards one another, the first and second magnetic elements magnetically attracting the first and second flexible legs, and a first elastic pocket that runs along the longitudinal length of the first outer face, the first elastic pocket having open transverse ends through which a temple of the glasses may be inserted.

7 Claims, 4 Drawing Sheets

FIG. 1A
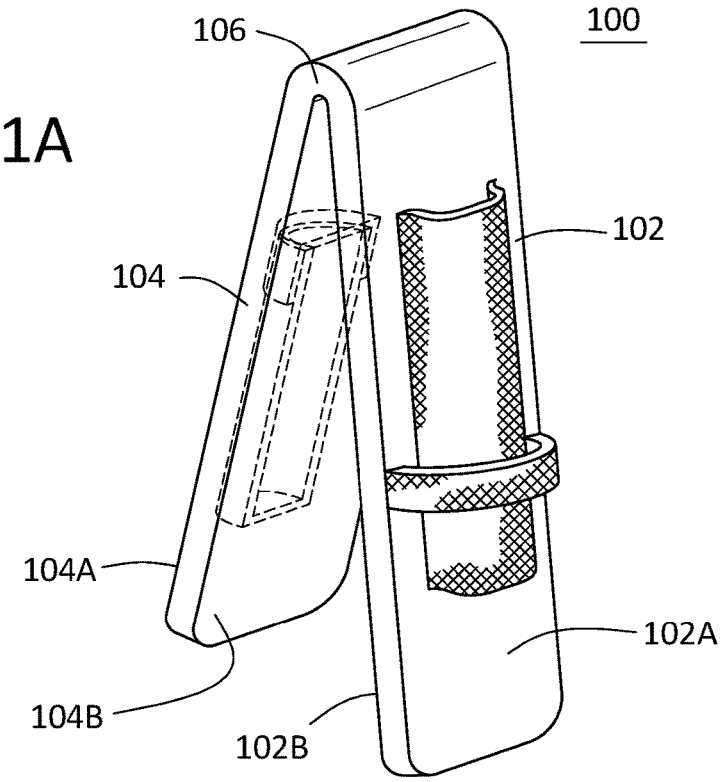
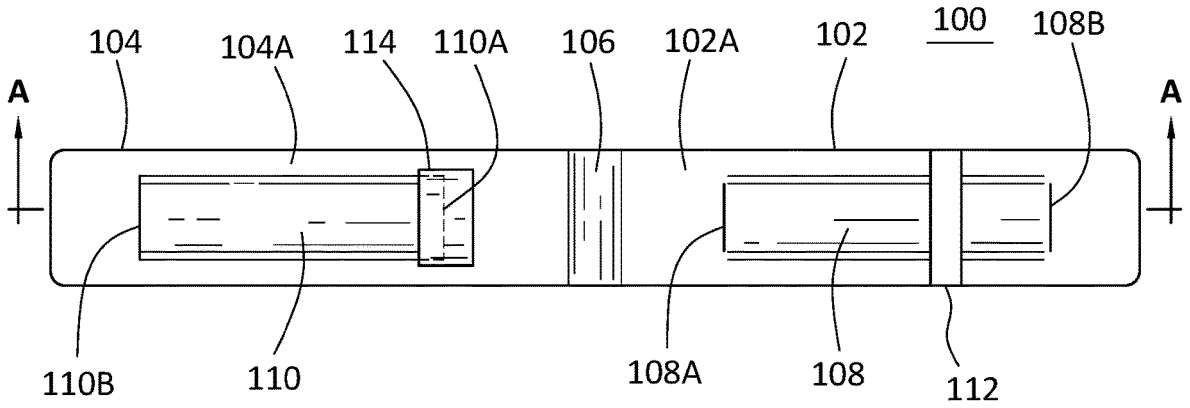
FIG. 1B

FIG. 4
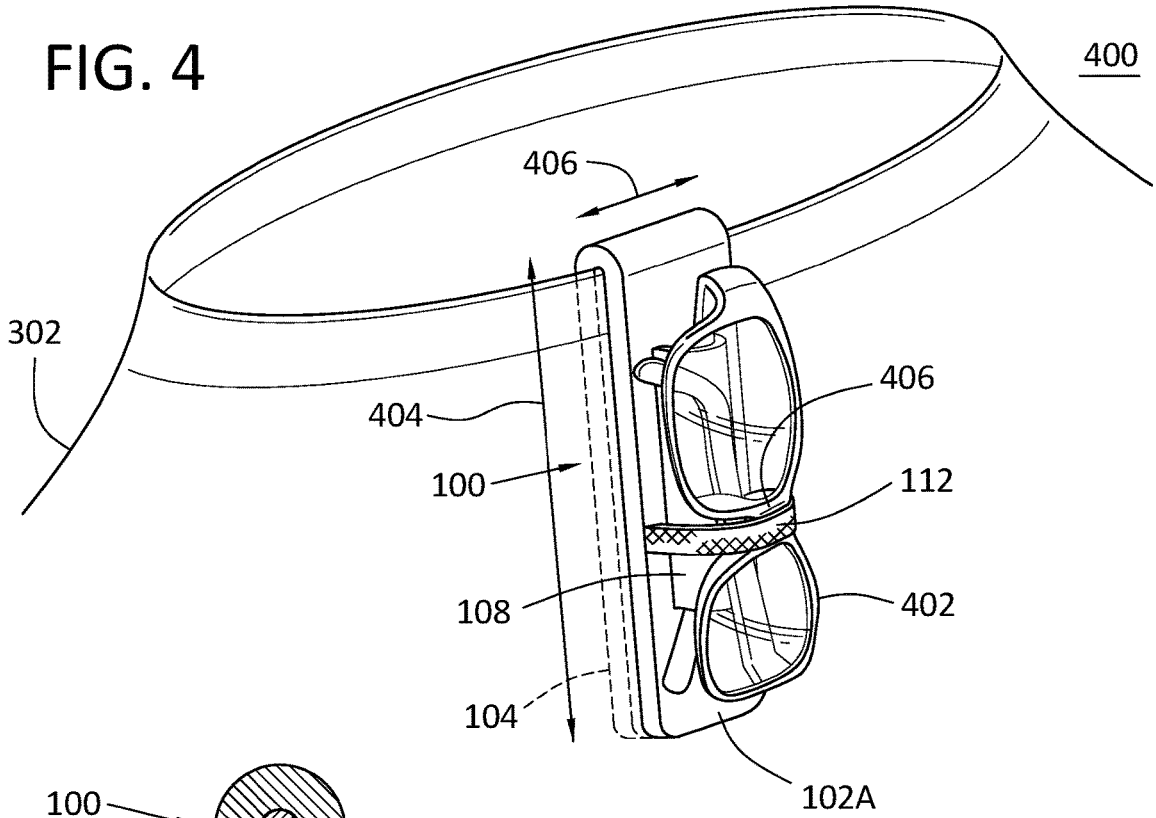
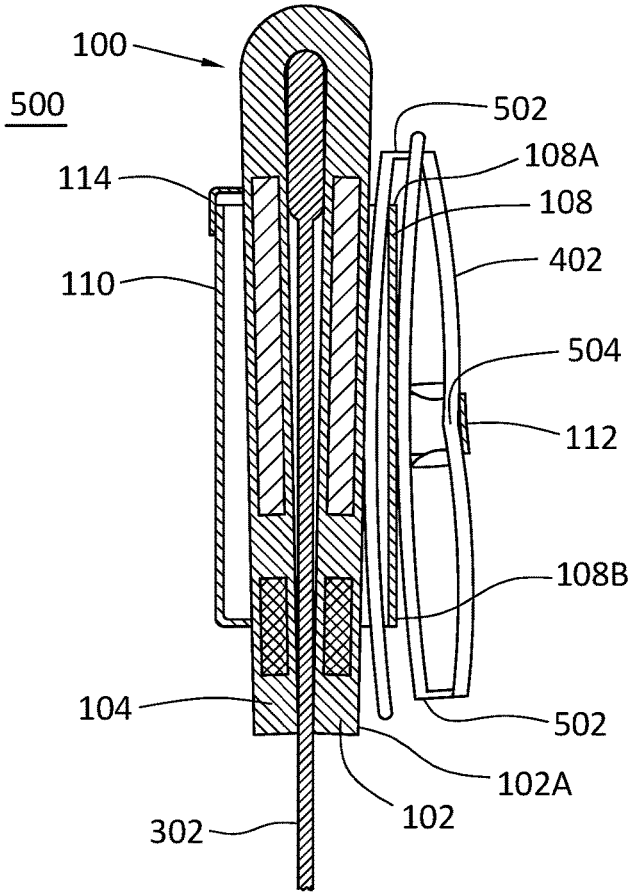
FIG. 5

MAGNETIC CLIPPING DEVICE FOR RETAINING GLASSES TO AN ARTICLE OF CLOTHING AND METHOD THEREOF

FIELD

This application relates to a magnetic clipping device for retaining glasses to an article of clothing, and more specifically to a clip with flexible legs that may be magnetically secured together with an article of clothing sandwiched in-between, a flexible leg including an elastic pocket for securing a pair of glasses to the magnetic clipping device.

BACKGROUND

It is a primary objective of the present disclosure to provide a magnetic clipping device for retaining glasses to an article of clothing. A person involved in a planned physical activity will often wear casual clothing. For example, a person may be planning a physical work out typically performed in a gym and, as such, may typically be wearing sweat pants or shorts and a t-shirt or sweatshirt type of top. Similarly, the person may be playing a team sport which similarly requires the person to wear a uniform that includes shorts and a t-shirt type of top. Lastly, the person may be running or jogging, which may also require sweat pants or shorts and a t-shirt or sweatshirt type of top.

The physical activity may require that the person remove their glasses for at least a portion of the activity. However, using a traditional pocket within sweat pants or shorts may damage the glasses as a result of the physical activity. Moreover, the t-shirt or sweatshirt type of top may often not include a pocket in which the glasses may be securely stored.

What is needed is a clipping device that is capable of securely attaching to a portion of an article of clothing, and that includes at least a one pocket in which a pair of glasses may be easily secured and removed.

SUMMARY

In some embodiments, a magnetic clipping device for retaining glasses to an article of clothing is provided. The magnetic clipping device including a first flexible leg that is generally planar shaped with a first inner face and first outer face, the first inner face and the first outer face opposite one another, and a first magnetic element embedded within the first flexible leg, the first magnetic element oriented such that a first magnetic pole extends from the first inner face and a second magnetic pole, opposite the first magnetic pole, extends from the first outer face. The magnetic clipping device further including a second flexible leg that is generally planar shaped with a second inner face and a second outer face, the second inner face and the second outer face opposite one another, and a second magnetic element embedded within the second flexible leg, the second magnetic element oriented such that the first magnetic pole extends from the second outer face and the second magnetic pole extends from the second inner face. The magnetic clipping device further including a hinge coupling the first flexible leg and the second flexible leg, the hinge allowing the first flexible leg and the second flexible leg to rotate towards one another as to sandwich a portion of the article of clothing in between the first flexible leg and the second flexible leg, the first magnetic pole magnetically attracting the second magnetic pole as to adhere the first inner face and the second inner face to the article of clothing sandwiched in between the first flexible leg and the second flexible leg. Lastly, the magnetic clipping device including a first elastic pocket that is generally rectangular shaped with opposite longitudinal edges and opposite transversal edges, the opposite longitudinal edges coupled to the first outer face and the opposite transversal edges left open.

In some embodiments, a method for manufacturing a magnetic clipping device for retaining glasses to an article of clothing is provided. The method including providing a first flexible leg that is generally planar shaped with a first inner face and a first outer face, the first inner face, and the first outer face opposite one another. The method further including embedding a first magnetic element within the first flexible leg, the first magnetic element oriented such that a first magnetic pole extends from the first inner face, and a second magnetic pole, opposite the first magnetic pole, extends from the first outer face. The method further including providing a second flexible leg that is generally planar shaped with a second inner face and a second outer face, the second inner face, and the second outer face opposite one another. The method further including embedding a second magnetic element within the second flexible leg, the second magnetic element oriented such that the first magnetic pole extends from the second outer face, and the second magnetic pole extends from the second inner face. The method further including coupling the first flexible leg and the second flexible leg to a hinge, the hinge allowing the first flexible leg and the second flexible leg to rotate towards one another as to sandwich a portion of the article of clothing in between the first flexible leg and the second flexible leg. The method further including providing that the first magnetic pole magnetically attracts the second magnetic pole as to adhere the first inner face and the second inner face to the article of clothing sandwiched in between the first flexible leg and the second flexible leg. Lastly, the method including providing a first elastic pocket that is generally rectangular shaped with opposite longitudinal edges and opposite transversal edges, the opposite longitudinal edges coupled to the first outer face and the opposite transversal edges left open.

Still, other aspects, features, and advantages of this disclosure may be readily apparent from the following detailed description, as illustrates by several example embodiments. This disclosure may also be capable of other and different embodiments, and its several details may be modified in various respects. Accordingly, the drawings and descriptions are to be regarded as illustrative and not as restrictive.

BRIEF DESCRIPTION OF THE DRAWINGS

The drawings, described below, are for illustrative purposes only and are not necessarily drawn to scale. The drawings are not intended to limit the scope of the disclosure in any way. Wherever possible, the same or like reference numbers are used throughout the drawings to refer to the same or like parts.

FIG. 1A illustrates a perspective view of a magnetic clipping device for retaining glasses to an article of clothing in accordance with the embodiments disclosed herein.

FIG. 1B illustrates a top view of a magnetic clipping device for retaining glasses to an article of clothing in accordance with the embodiments disclosed herein.

FIG. 4 illustrates a perspective view of a pair of glasses secured to the magnetic clipping device while retained on an article of clothing in accordance with the embodiments disclosed herein.

FIG. 5 is a cross-sectional side view of a pair of glasses secured to the magnetic clipping device while retained on an article of clothing in accordance with the embodiments disclosed herein.

DETAILED DESCRIPTION

Figure 2:
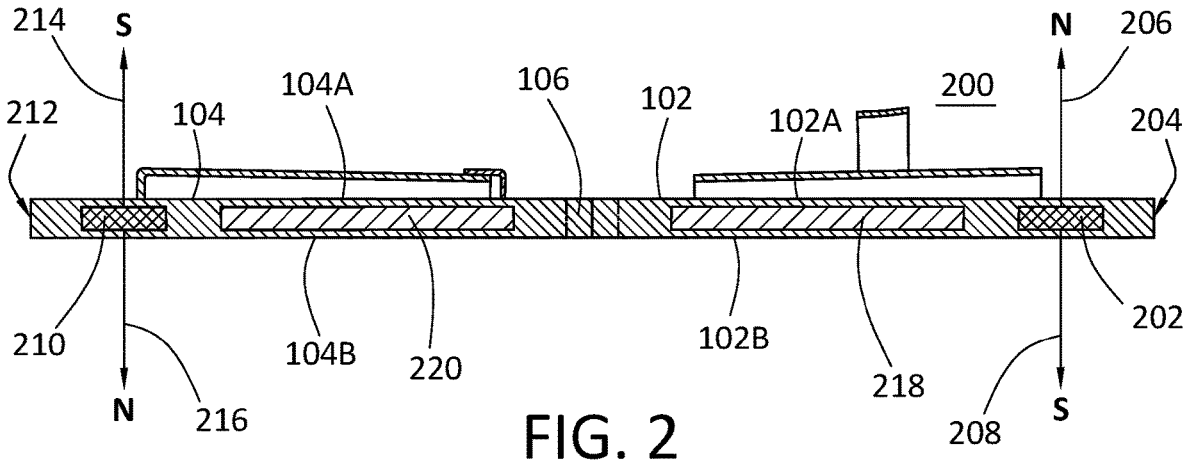
FIG. 2 illustrates a cross-sectional view along line A in FIG. 1B of the magnetic clipping device for retaining glasses to an article of clothing in accordance with the embodiments disclosed herein.

As mentioned above, this application relates to a magnetic clipping device for retaining glasses to an article of clothing.

In order to solve the above described problem, an exemplary embodiment of a magnetic clipping device for retaining glasses to an article of clothing is provided. An embodiment of the magnetic clip may include a first flexible leg and a second flexible leg, which are attached to one another by a hinge. The first and second flexible legs may each be generally planar shaped with an inner face and an opposite outer face. The hinge may bend sufficiently to allow the first and second flexible legs to rotate towards one another until their inner faces come into direct contact with each other. A first magnetic element may be embedded within the first flexible leg, and a second magnetic element may be embedded within the second flexible leg. The first and second magnetic elements may each be oriented as to magnetically attract the first and second flexible legs to one another. The magnetic clipping device may be removably secured to an article of clothing by sandwiching a portion of the article of clothing in between the magnetically attracted first and second flexible legs. The first and second magnetic elements force the inner faces of the first and second flexible legs against opposite sides of the sandwiched portion of the article of clothing.

A first elastic pocket may be coupled to the outer face of the first flexible leg. The first flexible pocket may be generally rectangular shaped with opposite longitudinal edges and opposite transversal edges. The opposite longitudinal edges may be coupled to the outer face while the opposite transversal edges are left open. A pair of glasses may be retained to the article of clothing by inserting one of the temples of the glassed into the first elastic pocket through the opposite open transversal edges.

A strap may also be removably coupled to the outer face of the first flexible leg. While coupled to the outer face, the strap may lay across the bridge of the pair of glasses to further secure the glasses against the outer face.

A second flexible pocket may be coupled to the outer face of the second flexible leg. The second flexible pocket may be coupled to the outer face along its opposite longitudinal edges and one of its opposite traversal edges, leaving the other traversal edge open.

FIG. 1A illustrates a perspective view of a magnetic clipping device 100 for retaining glasses to an article of clothing in accordance with the embodiments disclosed herein.

The magnetic clipping device 100 may include a first flexible leg 102, a second flexible leg 104, and a hinge 106.

The first flexible leg 102 may be generally planar shaped with a first inner face 102B and first outer face 102A, the first inner face 102B, and the first outer face 102A opposite one another. Similarly, the second flexible leg 104 may be generally planar shaped with a second inner face 104B and second outer face 104A, the second inner face 104B, and the second outer face 104A opposite one another.

The hinge 106 may be permanently coupled to one of the two longitudinal ends of the first flexible leg 102 and one of the two longitudinal ends of the second flexible leg 104. The hinge 106 may bend sufficiently to allow the first flexible leg 102 and the second flexible leg 104 to fold onto each other such that the first inner face 102B comes into direct contact with the second inner face 104B.

The first flexible leg 102, the second flexible leg 104, and the hinge 106 may each be composed of flexible material that is also resistant to moisture resulting from sweat or rain including silicon rubber. Any other reasonable material known to one of ordinary skill in the art may also be used.

FIG. 1B illustrates a top view of a magnetic clipping device 100 for retaining glasses to an article of clothing in accordance with the embodiments disclosed herein.

The first outer face 102A may include a first elastic pocket 108 secured to and running along the length of the first flexible leg 102. Similarly, the second outer face 104A may include a second elastic pocket 110 secured to and running along the length of the second flexible leg 104.

The first elastic pocket 108 may be rectangular shaped with opposite longitudinal edges and opposite transversal edges. The opposite longitudinal edges may be coupled to the first outer face 102A. The opposite transversal edges may be left unsecured and open. Specifically, the first elastic pocket 108 may include a first opening 108A at one end of the first elastic pocket 108 closest to the hinge 106 and a second opening 108B at an opposite end furthest from the hinge 106.

The second elastic pocket 110 may be rectangular shaped with opposite longitudinal edges and opposite transversal edges. The opposite longitudinal edges may be coupled to the second outer face 104A. A first of the opposite transversal edges may be coupled to the second outer face 104A while a second of the opposite transversal edges be left uncoupled or open. Specifically, the second elastic pocket 110 may include a single opening 110A at the traverse end of the second elastic pocket 110 closest to the hinge 106, the other traverse end 110B of the second elastic pocket 110 being coupled to the second outer face 104A.

The first elastic pocket 108 and the second elastic pocket 110 may each be composed of any elastic material known to one of ordinary skill in the art.

The longitudinal lengths of the first elastic pocket 108 and the second elastic pocket 110 may be the same. Alternatively, the longitudinal lengths of the first elastic pocket 108 and the second elastic pocket 110 may be different.

In one embodiment, the longitudinal lengths of the first elastic pocket 108 and the second elastic pocket 110 may range between 1.5 inches and 4 inches.

The first outer face 102A may further include a first strap 112 secured to and extending across the width of the first flexible leg 102.

The first strap 112 may be permanently secured to the first outer face 102A at one end and removably secured at an opposite end. This configuration allows one end of the first strap 112 to be removed and re-attached to the first outer face 102A.

The second outer face 104A may further include a pocket flap 114 secured to the second flexible leg 104 and positioned to extend across the full width of the single opening 110A of the second elastic pocket 110. The pocket flap 114 may be opened to allow access to single opening 110A of the second elastic pocket 110 and may be closed to secure the single opening 110A.

FIG. 2 illustrates a cross sectional view 200 along line A in FIG. 1B of the magnetic clipping device 100 for retaining glasses to an article of clothing in accordance with the embodiments disclosed herein.

A first magnetic element 202 may be embedded within the first flexible leg 102 at an end 204 opposite the hinge 106. The first magnetic element 202 may be oriented such that a first magnetic pole (N) 206 radiates outward from the first outer face 102A and a second magnetic pole (S) 208, opposite the first magnetic pole (N) 206, radiates outward from the first inner face 102B.

A second magnetic element 210 may be embedded within the second flexible leg 104 at an end 212 opposite the hinge 106. The second magnetic element 210 may be oriented such that the second magnetic pole (S) 214 radiates outward from the second outer face 104A and a first magnetic pole (N) 216, opposite the second magnetic pole (S) 214, radiates outward from the second inner face 104B.

The first magnetic element 202 and the second magnetic element 210 are each oriented such that the magnetic poles 206, 214 emanating from the first and second outer faces 102A, 104A are magnetically attractive to one another. Similarly, the magnetic poles 208, 216 emanating from the first and second inner faces 102B, 104B are magnetically attractive to one another.

A first rigid element 218 may be embedded within the first flexible leg 102 positioned in-between the first magnetic element 202 and the hinge 106. Similarly, a second rigid element 220 may be embedded within the second flexible leg 104 positioned in-between the second magnetic element 210 and the hinge 106.

The first rigid element 218 and the second rigid element 220 may each be comprised of any rigid material know to a person of ordinary skill in the art including metal and plastic.

Figure 3:
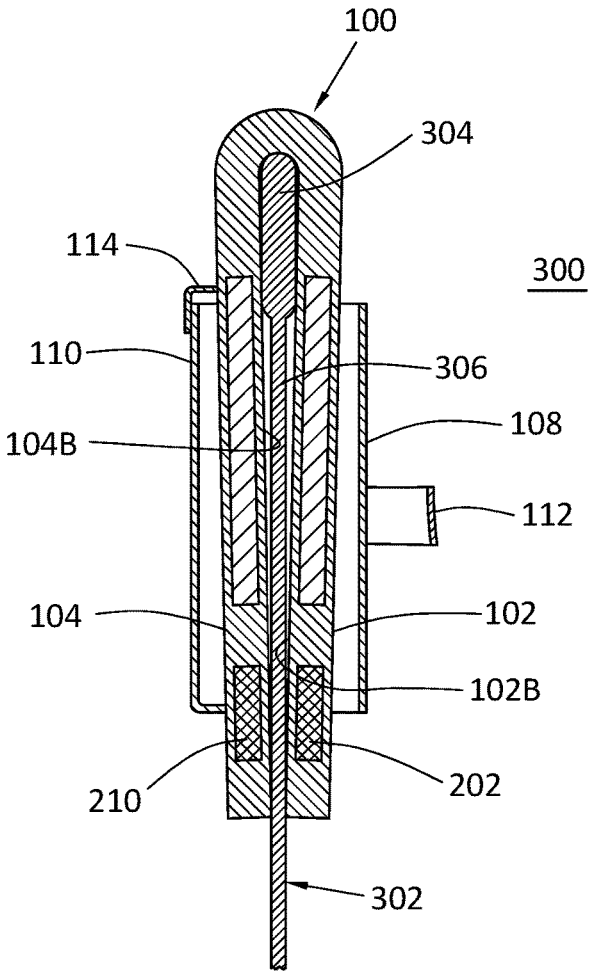
FIG. 3 illustrates a cross-sectional side view of the magnetic clipping device while retained on an article of clothing in accordance with the embodiments disclosed herein.

FIG. 3 illustrates a cross-sectional side view 300 of the magnetic clipping device 100 while retained on an article of clothing 302 in accordance with the embodiments disclosed herein.

The article of clothing 302 shown in FIG. 3 is a T-shirt that includes a collar portion 304 and a chest portion 306. However, the article of clothing 302 may be any clothing type with a portion of material capable of being sandwiched between the first flexible leg 102 and the second flexible leg 104 of the magnetic clipping device 100.

As shown in FIG. 3, the magnetic clipping device 100 may be folded over the collar 304 as to sandwich a part of the chest portion 306 in between the first flexible leg 102 and the second flexible leg 104. The first magnetic element 202 and the second magnetic element 210 are magnetically attracted to one another through the chest portion 306 of the article or clothing 302.

The magnetic attraction between the first and second magnetic elements 202, 210 functions to align the first flexible leg 102 with the second flexible leg 104 and to bias the first inner face 102B and the second inner face 104B against opposite sides of the article of clothing 302. The friction between the first and second inner faces 102B, 104B and the material composing the article of clothing 302 helps to minimize movement of the magnetic clipping device 100 relative to the article of clothing 302.

With the first and second inner face 102B, 104B pressing against the article of clothing 302, both the first elastic pocket 108 and the second elastic pocket 110 are accessible outside of the article of clothing 302.

The placement of the first magnetic element 202 at the end 204 of the first flexible leg 102 opposite the hinge 106 and of the second magnetic element 210 the end 212 opposite the hinge 106 on the second flexible leg 104 allows the hinge 106 to freely expand and contact around a portion of the article of clothing 302 to which the magnetic clip 100 is retained. Specifically, as shown in FIG. 3, the hinge 106 may freely expand and contract to accommodate the width and shape of the color portion 304 of the article of clothing 302 that may be different than that of the chest portion 306.

FIG. 4 illustrates a perspective view 400 of a pair of glasses 402 secured to the magnetic clipping device 100 while retained on an article of clothing 302 in accordance with the embodiments disclosed herein.

As shown, the magnetic clipping device 100 may be oriented with the first flexible leg 102 outside the article of clothing 302. In this orientation, the pair of glasses 402 may be secured against the first outer face 102A using the first elastic pocket 108 and the first strap 112.

Alternatively, the magnetic clipping device 100 may be oriented with the second flexible leg 104 outside the article of clothing 302. In this orientation, the second elastic pocket 110 (not shown) may be accessed through the single opening 110A (not shown). The single opening may be secured using the pocket flap 114 (not shown).

The first flexible leg 102 and the second flexible leg 104 may each be shaped to follow the general contour of any pair of glasses 302 that are to be secured to the magnetic clipping device 100. Moreover, the first flexible leg 102 and the second flexible leg 104 may each have a longitudinal length 404 and a traversal width 406 that are sufficient to cover the dimensions of any pair of glasses that are to be secured to the magnetic clip.

FIG. 5 is a cross-sectional side view 500 of a pair of glasses 402 secured to the magnetic clipping device 100 while retained on an article of clothing 302 in accordance with the embodiments disclosed herein.

The pair of glasses 402 may include a pair of temples 502 attached to each end of the pair of glasses 402 and a bridge 504 positioned at the center of the pair of glasses 402.

As shown, to secure the pair of glasses 402 to the first outer face 102A, any one of the pair of temples 502 may be inserted into the first elastic pocket 108.

Specifically, the temple 502 may be inserted into the first opening 108A of the first elastic pocket 108 and pushed through its length until a portion of the temple 502 exists through the second opening 108B of the first elastic pocket 108.

Once the temple 502 has been inserted into the first elastic pocket 108, a major portion of the temple 502 will be pulled towards the first outer face 102A by the elastic quality of the first elastic pocket 108.

As also shown in FIG. 5, to further secure the pair of glasses 402 to the first outer face 102A, the first strap 112 may be folded across the bridge 504 of the pair of glasses 402 and secured to the first outer face 102A.

Figure 6:
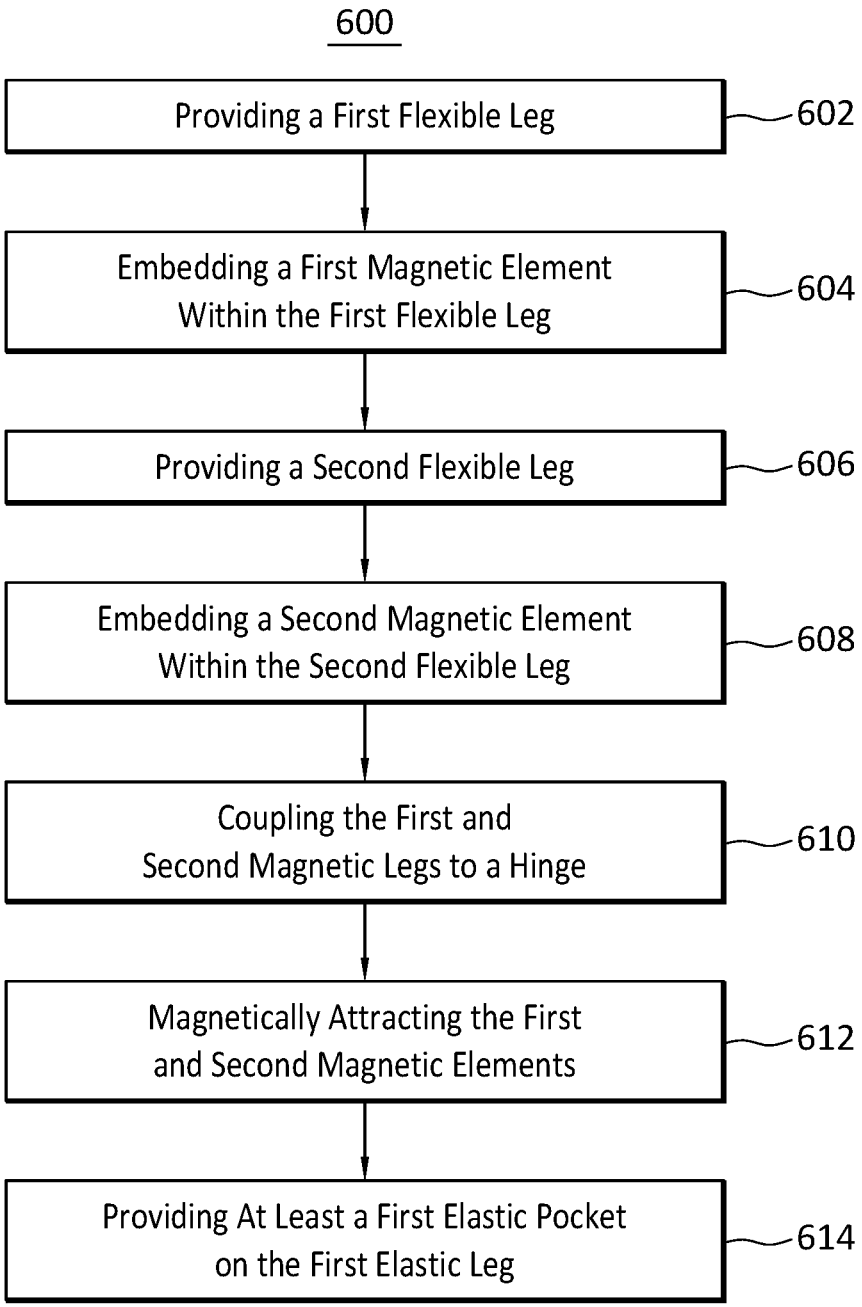
FIG. 6 illustrates a flowchart depiction of a method of adhering a pair of glasses to an article of clothing using a magnetic clipping device in accordance with the embodiments disclosed herein.

FIG. 6 illustrates a flowchart depiction of a method 600 of adhering a pair of glasses to an article of clothing using a magnetic clipping device in accordance with the embodiment disclosed herein.

The method 600 includes, in step 602, providing a first flexible leg with a first inner face and a first outer face, the first inner face, and a first outer face, each having a planar shape opposite one another.

The method 600 further includes, in step 604, embedding a first magnetic element within the first flexible leg, the first magnetic element having first magnetic pole extending perpendicular to the first inner face and the first outer face.

The method 600 further includes, in step 606, providing a second flexible leg with a second inner face and a second outer face, the second inner face, and a second outer face, each having a planar shape opposite one another.

The method 600 further includes, in step 608, embedding a second magnetic element within the second flexible leg, the second magnetic element having second magnetic pole extending perpendicular to the second inner face and the second outer face.

The method 600 further includes, in step 610, coupling the first flexible leg and the second flexible leg to a hinge, the hinge allowing the first flexible leg and the second flexible leg to bend towards one another as to sandwich the article of clothing in between the first flexible leg and the second flexible leg.

The method 600 further includes, in step 612, providing that the first magnetic poles magnetically attracts the second magnetic poles as to adhere the first inner face and the second inner face to the article of clothing sandwiched in between the first flexible leg and the second flexible leg.

Lastly, the method 600 further includes, in step 614, providing at least a first elastic pocket running along the longitudinal length of the first outer face, the first elastic pocket having open transverse ends through which a temple of the glasses may be inserted.

The foregoing description discloses only example embodiments. Modifications of the above-disclosed assemblies and methods which fall within the scope of this disclosure will be readily apparent to those of ordinary skill in the art.

This disclosure is not intended to limit the invention to the particular assemblies and/or methods disclosed, but, to the contrary, the intention is to cover all modifications, equivalents, and alternatives falling within the scope of the claims.

What is claimed is:

1. A magnetic clipping device for retaining glasses to an article of clothing, comprising:

a first flexible leg that is generally planar shaped with a first inner face and first outer face, the first inner face and the first outer face opposite one another;

a first magnetic element embedded within the first flexible leg, the first magnetic element oriented such that a first magnetic pole extends from the first inner face and a second magnetic pole, opposite the first magnetic pole, extends from the first outer face;

a second flexible leg that is generally planar shaped with a second inner face and a second outer face, the second inner face and the second outer face opposite one another;

a second magnetic element embedded within the second flexible leg, the second magnetic element oriented such that the first magnetic pole extends from the second outer face and the second magnetic pole extends from the second inner face;

a hinge coupling the first flexible leg and the second flexible leg, the hinge allowing the first flexible leg and the second flexible leg to rotate towards one another as to sandwich a portion of the article of clothing in between the first flexible leg and the second flexible leg;

the first magnetic pole magnetically attracting the second magnetic pole as to adhere the first inner face and the second inner face to the article of clothing sandwiched in between the first flexible leg and the second flexible leg;

a first elastic pocket that is generally rectangular shaped with opposite longitudinal edges and opposite transversal edges, the opposite longitudinal edges coupled to the first outer face and the opposite transversal edges left open; and a first strap removably coupled to the first outer face, the first strap positioned to sit over a bridge of the glasses whose temple has been inserted into the first elastic pocket as to secure the glasses against the first flexible leg.

2. The magnetic clipping device of claim 1 wherein the first magnetic element is embedded at an extremity of the first flexible leg opposite the hinge and the second magnetic element is embedded at an extremity of the second flexible leg opposite the hinge.

3. The magnetic clipping device of claim 2 further comprising a first rigid element embedded within the first flexible leg in between the first magnetic element and the hinge and a second rigid element embedded within the second flexible leg in between the second magnetic element and the hinge.

4. The magnetic clipping device of claim 1 wherein the first flexible leg and the second flexible leg are composed of silicone rubber.

5. The magnetic clipping device of claim 1 wherein the hinge is composed of silicone rubber.

6. A method of magnetically clipping a pair of glasses to an article of clothing comprising:

providing a first flexible leg that is generally planar shaped with a first inner face and a first outer face, the first inner face and the first outer face opposite one another;

embedding a first magnetic element within the first flexible leg, the first magnetic element oriented such that a first magnetic pole extends from the first inner face and a second magnetic pole, opposite the first magnetic pole, extends from the first outer face;

providing a second flexible leg that is generally planar shaped with a second inner face and a second outer face, the second inner face and the second outer face opposite one another;

embedding a second magnetic element within the second flexible leg, the second magnetic element oriented such that the first magnetic pole extends from the second outer face and the second magnetic pole extends from the second inner face;

coupling the first flexible leg and the second flexible leg to a hinge, the hinge allowing the first flexible leg and the second flexible leg to rotate towards one another as to sandwich a portion of the article of clothing in between the first flexible leg and the second flexible leg;

providing that the first magnetic pole magnetically attracts the second magnetic pole as to adhere the first inner face and the second inner face to the article of clothing sandwiched in between the first flexible leg and the second flexible leg;

providing a first elastic pocket that is generally rectangular shaped with opposite longitudinal edges and opposite transversal edges, the opposite longitudinal edges coupled to the first outer face and the opposite transversal edges left open; and providing a first strap removably coupled to the first outer face, the first strap positioned to sit over a bridge of the glasses whose temple has been inserted into the first elastic pocket as to secure the glasses against the first flexible leg.

7. A magnetic clipping device for retaining glasses to an article of clothing, comprising:

a first flexible leg that is generally planar shaped with a first inner face and first outer face, the first inner face and the first outer face opposite one another;

a first magnetic element embedded within the first flexible leg, the first magnetic element oriented such that a first magnetic pole extends from the first inner face and a second magnetic pole, opposite the first magnetic pole, extends from the first outer face;

a second flexible leg that is generally planar shaped with a second inner face and a second outer face, the second inner face and the second outer face opposite one another;

a second magnetic element embedded within the second flexible leg, the second magnetic element oriented such that the first magnetic pole extends from the second outer face and the second magnetic pole extends from the second inner face;

a hinge coupling the first flexible leg and the second flexible leg, the hinge allowing the first flexible leg and the second flexible leg to rotate towards one another as to sandwich a portion of the article of clothing in between the first flexible leg and the second flexible leg;

the first magnetic pole magnetically attracting the second magnetic pole as to adhere the first inner face and the second inner face to the article of clothing sandwiched in between the first flexible leg and the second flexible leg;

a first elastic pocket that is generally rectangular shaped with opposite longitudinal edges and opposite transversal edges, the opposite longitudinal edges coupled to the first outer face and the opposite transversal edges left open; and a second elastic pocket that is generally rectangular shaped with opposite longitudinal edges and opposite transversal edges, the opposite longitudinal edges and a first of the opposite transversal edges coupled to the second outer face, a second of the opposite transversal edges left open.

* * * * *